US006010039A

United States Patent [19]

Bougamont

[11] Patent Number: 6,010,039

[45] Date of Patent: Jan. 4, 2000

[54] SYSTEM FOR PROVIDING SEALED ASSEMBLY BETWEEN A MINIATURE PUMP AND A RESERVOIR OF SMALL CAPACITY

[75] Inventor: Jean-Louis Bougamont, Eu, France

[73] Assignee: Sofab, LeTreport, France

[21] Appl. No.: 08/906,472

[22] Filed: Aug. 5, 1997

[30] Foreign Application Priority Data

Aug. 5, 1996 [FR] France ..... 96 09866

[51] Int. Cl.[7] ..... B65D 88/54; B67D 5/40

[52] U.S. Cl. ..... 222/321.9; 222/321.7; 222/385

[58] Field of Search ..... 222/321.1, 321.7, 222/321.9, 385, 183

[56] References Cited

U.S. PATENT DOCUMENTS

| | | | |
|---|---|---|---|
| 4,311,255 | 1/1982 | Meshberg | 222/183 |
| 4,930,999 | 6/1990 | Brunet et al. | 222/321.2 |
| 4,955,511 | 9/1990 | Blake | 222/321.7 |
| 5,102,018 | 4/1992 | Desazars De Montgailhard et al. | 222/321 |
| 5,242,089 | 9/1993 | Knickerbocker et al. | 222/321.7 |
| 5,449,094 | 9/1995 | Behar et al. | 222/321.3 |
| 5,548,943 | 8/1996 | Behar et al. | 53/473 |
| 5,595,326 | 1/1997 | Bougamont et al. | 222/321.7 |
| 5,642,908 | 7/1997 | Mascitelli | 222/321.7 |
| 5,709,324 | 1/1998 | Peronnet et al. | 222/321.1 |

FOREIGN PATENT DOCUMENTS

| | | |
|---|---|---|
| 0 571 280 | 11/1993 | European Pat. Off. . |
| 0 628 355 | 12/1994 | European Pat. Off. . |
| 0628355 | 12/1994 | European Pat. Off. . |

*Primary Examiner*—Andres Kashnikow
*Assistant Examiner*—Keats Quinalty
*Attorney, Agent, or Firm*—Bacon & Thomas, PLLC

[57] ABSTRACT

An assembly system for providing sealed assembly between a miniature pump whose body is supported by a sleeve, and a reservoir of small capacity, by forced internal or external engagement, wherein the side wall of the sleeve or of the reservoir includes a grooved zone forming a vent which is longitudinally terminated by an adjacent smooth zone; the zones being designed to slide with radial clamping over the entire length relative to a smooth portion of the facing wall of the reservoir or of the sleeve for the purpose of progressively closing the grooved zone and coming into sealing contact with the smooth zone at the completion of the engagement.

12 Claims, 4 Drawing Sheets

C
T
M
P
R
E 5
2
1
C
4
4a
M 1
10
M 2
r
C
3
R
4a
1
M
4

R
3
M
1
10

C
3
R
5
2
1
M

R
3
M
2

C
R
1
2
3
5
M
r
10

C
1
2
4
4a
5
6
M
10

1
2
C
40
6
M
3
R
40a
40b
40c
10

SYSTEM FOR PROVIDING SEALED ASSEMBLY BETWEEN A MINIATURE PUMP AND A RESERVOIR OF SMALL CAPACITY

The present invention relates to a system for providing sealed assembly between a miniature pump and a reservoir of small capacity.

More precisely, it relates to providing sealed assembly between a miniature pump and a reservoir where the pump body is supported by a sleeve, the pump being mounted by forced engagement on the neck of a receptacle constituting the reservoir; the engagement being internal or external.

BACKGROUND OF THE INVENTION

Dispensers of samples of liquids such as miniature sprays are generally assembled after the reservoir has been filled.

The reservoir is closed by forced sealed engagement of the pump-supporting sleeve, and that can cause the pressure of the air inside the reservoir to rise excessively, particularly when no means exist for venting the compressed air.

Such excess pressure then gives rise to the liquid being suddenly squirted and sprayed when the pump is used for the first time.

A known method of avoiding such excess pressure consists in opening the vent of the pump by pressing its head down during assembly, as described in EP 408 421 (SOFAB). However, when the dispenser is delivered with a cap, it is desirable for economic reasons to assemble the pump already fitted with its cap. Under such circumstances, it is no longer possible to open its vent since the head of the pump is not accessible.

Another technique consists in making a longitudinal groove in the side wall of the sleeve or the reservoir, thereby allowing compressed air to escape, which groove is closed at its top end by a transverse shoulder, as described in U.S. Pat. No. 4,311,255 (MESHBERG).

Nevertheless, that technical solution is not satisfactory with respect to final sealing of the assembly, given that the groove is closed by walls of small area moving together and then making contact.

It is necessary not only to ensure proper venting and sealing, but also to provide mechanical cohesion between the pump and the reservoir. Unfortunately, such cohesion increases with increasing height of the radial clamping bearing surfaces on the sleeve and on the reservoir.

OBJECT AND BRIEF SUMMARY OF THE INVENTION

An object of the present invention is to solve the above technical problems in satisfactory manner.

According to the invention, this object is achieved by means of an assembly system for providing sealed assembly between a miniature pump whose body is supported by a sleeve, and a reservoir of small capacity, by forced internal or external engagement, wherein the side wall of the sleeve or of the reservoir includes a grooved zone forming a vent which is longitudinally terminated by an adjacent smooth zone; said zones being designed to slide with radial clamping over their full height relative to a smooth portion of the facing wall of the reservoir or of the sleeve for the purpose of progressively closing said grooved zone and coming into sealing contact with the smooth zone at the end of assembly.

According to an advantageous characteristic, the grooved zone is of a diameter that is identical to or smaller by no more than 5% than the diameter of the adjacent smooth zone.

According to another characteristic, said sleeve includes a top shoulder constituting a stop for the free edge of the reservoir.

In a first embodiment, said grooved zone and smooth zone are made on the inside wall of the reservoir, for internal engagement of the sleeve.

In a second embodiment, said grooved zone and said smooth zone are formed on the outside wall of the reservoir for external engagement of the sleeve.

In a third embodiment, said grooved zone and smooth zone are made on the inside wall of the sleeve for external engagement thereof.

In a fourth embodiment, said grooved zone and said smooth zone are formed in the outside wall of the sleeve for internal engagement thereof.

According to a characteristic associated with the third and four embodiments, said grooved zone is situated beneath said smooth zone and extends downwards in the form of a bottom zone of smaller diameter.

According to a characteristic associated with the second and third embodiments, the side wall of the reservoir has a bottom shoulder forming a stop for the free edge of the side wall of the sleeve.

According to other characteristics, the grooved zone is terminated remote from the smooth zone by a chamfered edge, and where appropriate, the free edge of the side wall of the sleeve and/or of the reservoir is chamfered.

In a particular embodiment, said grooved zone includes a single longitudinal groove.

The invention also provides a method of assembling a miniature pump in sealed manner on a reservoir of small capacity that has previously been filled with liquid, the body of the pump being supported by a sleeve, wherein the sleeve is positioned on the axis of the neck of the reservoir and is engaged by force, internally or externally, so as initially to cause compressed air to escape via a grooved zone of the sleeve or of the reservoir, and then to achieve final sealing by peripheral radial clamping between smooth zones of facing bearing surfaces of the sleeve and of the reservoir.

In a first implementation, the forced engagement is performed at constant speed in continuous manner so as to maintain permanent equilibrium, at least during venting, between the air pressure inside and the air pressure outside the reservoir.

In another variant, the forced engagement is performed in discontinuous manner, with a first thrust step during which excess air pressure is generated inside the reservoir followed by a pause during which the engagement position already obtained is maintained to allow the compressed air to escape, until equilibrium is established between the air pressure inside and the air pressure outside the reservoir, followed by a second step during which the grooved zone is closed and then final sealing is obtained.

The assembly system and method of the invention make it possible to obtain a sample dispenser with a cap that can be assembled particularly simply and quickly since only one assembly operation suffices.

The assembly system of the invention relies on combining a grooved zone, an adjacent smooth zone, and a facing smooth wall designed to slide relative thereto with radial clamping on contact between said zones.

Since the smooth wall is in radial clamping contact both with the smooth zone and with the grooved zone, each of those zones contributes to the mechanical cohesion of the assembly.

This combination makes it possible to achieve simultaneously degassing that is effective and continuous during engagement, good sealing at the end of assembly because of the large surface areas of the bearing surfaces in peripheral radial clamping, and good mechanical cohesion of the pump on the reservoir because of the large height of the clamped-together bearing surfaces.

The grooved zone is closed progressively by sliding until complete sealing is obtained, with increasing surface area of the facing bearing surfaces.

The final sliding stage provides increased sealing by putting parallel smooth zones into contact over a height that is determined as a function of the acceptable, small, excess pressure.

The relative sliding between the facing bearing surfaces is performed very easily given the nature of the component material which behaves plastically.

Nevertheless, forced engagement gives rise to reaction between the radially clamped parts, and this gives rise in particular to elastic deformation of the zones that are in contact and more specifically by the inside walls being compressed and the outside walls being stretched. To guarantee good mechanical cohesion and satisfactory final sealing, it may then be appropriate to provide for the outside diameter of the free zone to be slightly greater (by not more than 5%) than the diameter of the grooved zone which can be compressed more easily.

The system of the invention is equally applicable to external and internal engagement of the sleeve, thereby providing numerous possibilities concerning the ways in which the dispenser can be embodied.

BRIEF DESCRIPTION OF THE DRAWINGS

The invention will be better understood on reading the following description accompanied by the drawings, in which.

FIGS. (4*a,* 4*b,* 4*c*), (5*a,* 5*b,* 5*c*), and (6*a,* 6*b,* 6*c*) are section views (corresponding to those of the preceding figures) of a second embodiment respectively prior to engagement, during internal engagement, and at the end of assembly;

FIGS. (7*a,* 7*b,* 7*c*), (8*a,* 8*b,* 8*c*), and (9*a,* 9*b,* 9*c*) are section views (corresponding to those of the preceding figures) of a third embodiment respectively prior to engagement, during external engagement, and at the end of assembly; and FIGS. (10*a,* 10*b,* 10*c*), (11*a,* 11*b,* 11*c*), and (12*a,* 12*b,* 12*c*) are section views (corresponding to those of the preceding figures) of a fourth embodiment respectively prior to engagement, during external engagement, and at the end of assembly.

MORE DETAILED DESCRIPTION

Figures 1A, 1B, 1C, 2A, 2B, 2C, 3A, 3B, 3C:
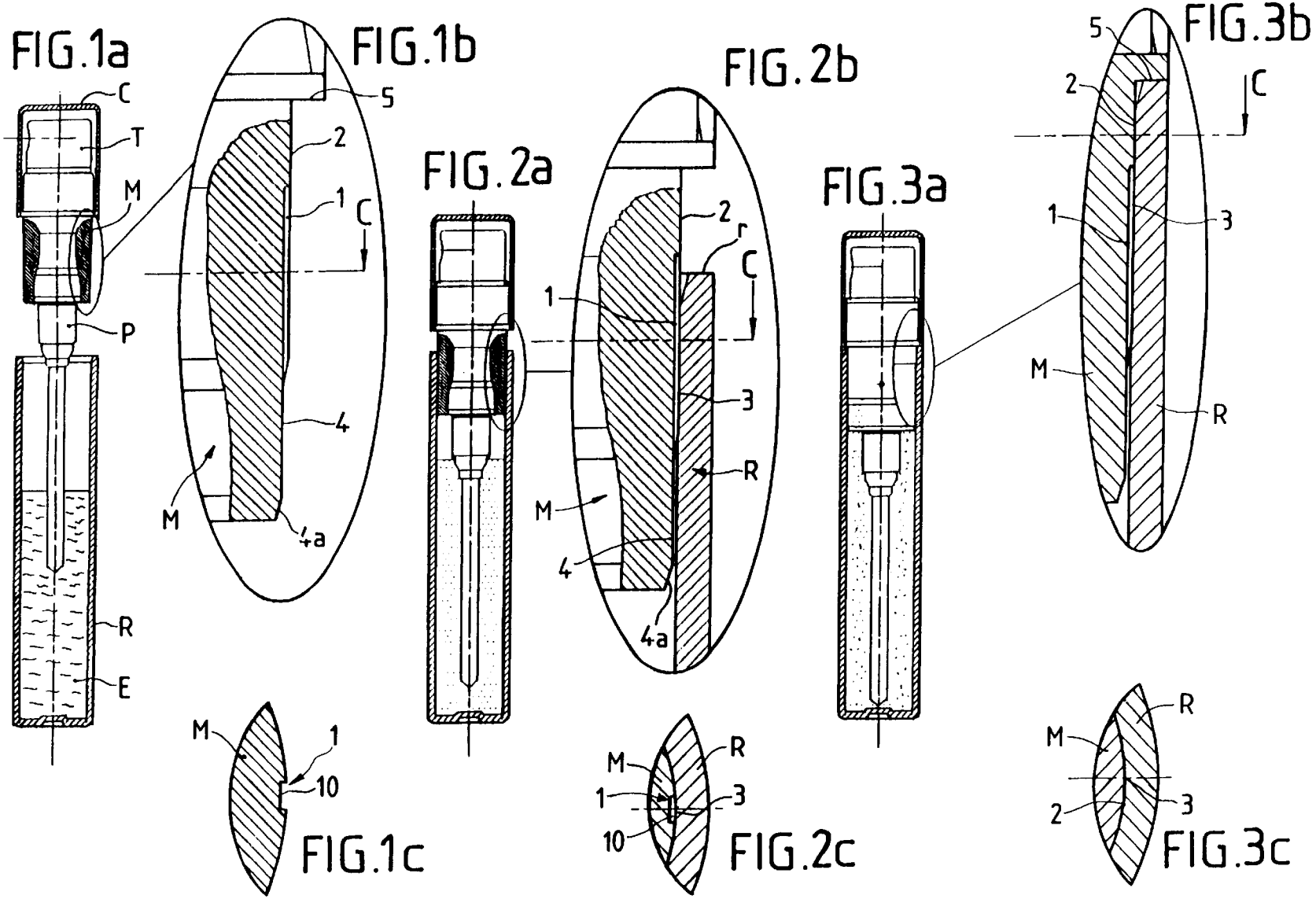
FIGS. 1*a* and 1*b* are vertical section views (a detail view in FIG. 1*b*) showing a first embodiment of the invention prior to engagement.
FIG. 1*c* is a detail view in horizontal section on CC of the embodiment shown in FIGS. 1*a* and 1*b;*
FIGS. 2*a,* 2*b,* and 2*c* are section views corresponding to those of FIGS. 1*a,* 1*b,* and 1*c* showing the same embodiment, but during internal engagement.
FIGS. 3*a,* 3*b,* and 3*c* are section views corresponding to those of FIGS. 1*a,* 1*b,* and 1*c,* still for the same embodiment, but at the end of assembly.

FIG. 1*a* is a vertical section view of a miniature dispenser prior to assembly.

The dispenser comprises a pump P whose body is supported by a sleeve M and whose pushbutton-forming head T is covered by a cap C resting on the sleeve M.

The sleeve M is designed to be a force-fit, internally in this case, in a reservoir R of small capacity previously filled with a sample E of a liquid.

The detail section view of FIG. 1*b* shows one side of the side wall of the sleeve M. The outside face of this wall has a grooved zone 1 through which there escapes the air which is compressed inside the reservoir R above the free surface of the liquid E, as the sleeve M moves down.

In the embodiment shown in FIGS. 1*a,* 1*b,* and 1*c,* the grooved zone 1 is constituted by only one longitudinal groove 10. In another embodiment (not shown) the grooved zone 1 may be constituted by a series of mutually parallel longitudinal grooves 10, formed peripherally around the side wall of the sleeve or indeed, in another embodiment, formed as a helical groove.

The grooved zone 1 is terminated longitudinally, in this case upwards, by an adjacent smooth zone 2 whose outside diameter is identical to or not more than 5% greater than the diameter of the grooved zone 1.

In this case, the grooved zone is extended downwards by a smaller-diameter bottom zone 4 designed to facilitate insertion of the sleeve M in the neck of the reservoir R.

The bottom edge of the zone 4 is preferably chamfered at 4*a* to facilitate the admission of compressed air into the grooved zone 1.

FIGS. 2*a,* 2*b,* and 2*c* show the assembly system of the invention during the stage of internally engaging the sleeve M in the reservoir R.

The neck of the reservoir R has an inside wall that is smooth, at least in the portion 3 which faces the outside face of the side wall of the sleeve M as shown in FIG. 2*b*.

Engagement is performed by sliding the smooth portion 3 of the wall of the reservoir R initially with radial clamping in contact with the grooved zone 1, thereby leading in a first stage to the groove 10 being closed laterally, as shown in the plan view in section of FIG. 2*c*.

During this stage, radial clamping is not peripheral because of the presence of the groove 10 and because the pump P is already mechanically secured in part to the reservoir R. The groove 10 is closed progressively from the bottom upwards, but the vent duct formed in this way remains open to the outside at its top.

During forced engagement, sliding continues and the top edge r of the smooth portion 3 of the wall of the reservoir R reaches the top end of the grooved zone 1.

If the top edge r of the reservoir R is chamfered, as shown in FIG. 2*b,* then compressed air can continue to be vented.

Otherwise the groove 10 is then definitively closed.

With relative sliding continuing beyond this position, the respective bearing surfaces of the smooth portion 3 of the wall of the reservoir R and the smooth zone 2 of the sleeve M are brought into peripheral radial clamping engagement in the top portions thereof, thereby guaranteeing good and complete sealing of the reservoir R at the end of assembly as shown in FIGS. 3*a,* 3*b,* and 3*c*. The heights of the bearing surfaces that are clamped peripherally and radially may be determined as a function of the excess pressure that can be accepted in the reservoir R after the grooved zone 1 has been closed. This excess pressure is proportional to the relative stroke performed by the smooth zones 2 and 3 of the contacting bearing surfaces beyond the limiting position for closing the grooved zone 1.

Since forced engagement compresses the internal bearing surfaces and stretches the external bearing surfaces, it is sometimes appropriate to increase slightly the outside diameter of the smooth zone 2 (e.g. by 3%) relative to that to the grooved zone 1 so as to guarantee both mechanical cohesion of the assembly and final sealing.

Also, both the grooved zone 1 and the smooth zone 2 participate in the mechanical cohesion of the assembly since both zones are radially clamped over their full heights with respect to the smooth bearing surface 3.

Since the clamping of the grooved zone is not peripheral, its height can be increased without that generating excess pressure, thereby reinforcing assembly strength, providing the resulting lengthening of the air path is not prejudicial to air escaping.

The smooth zone 2 is preferably terminated away from the grooved zone 1 by a top shoulder 5 extending outwardly from the sleeve M and forming a stop against a transverse face of the facing wall, represented in this case by the free edge r of the reservoir R.

Figures 4A, 4B, 4C, 5A, 5B, 5C, 6A, 6B, 6C:
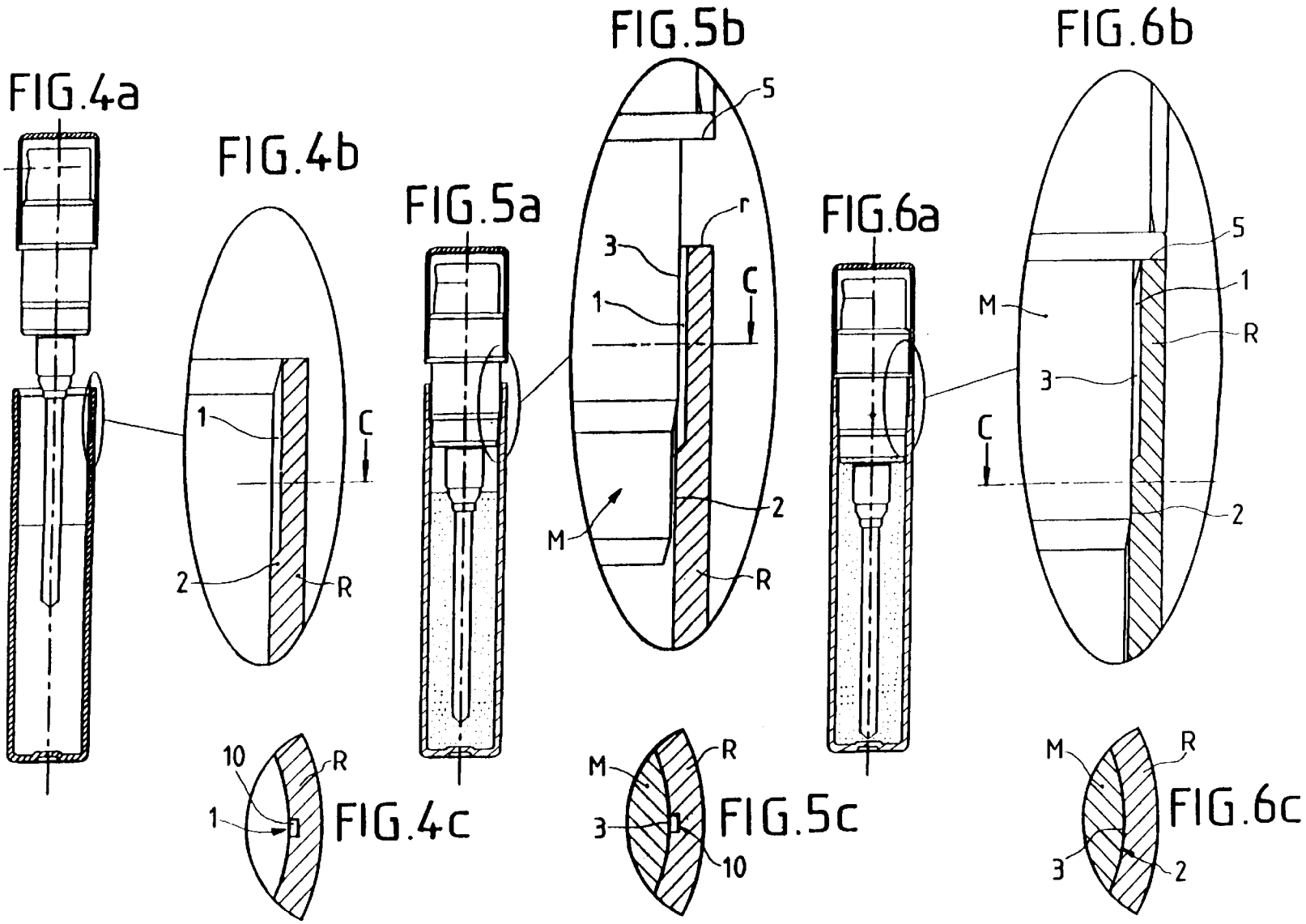

In the embodiment of FIGS. 4*a,* 4*b,* and 4*c,* the grooved zone 1 and the smooth zone 2 are carried by the inside wall of the reservoir R, likewise for the purpose of internal engagement of the sleeve M. Nevertheless, in this case the smooth zone 2 is situated beneath the grooved zone 1.

These zones 1 and 2 are designed to co-operate with a smooth portion 3 formed on the outside face of the side wall of the sleeve M.

Sliding takes place as described with reference to FIGS. 2*b* and 3*b,* but with the system being inverted.

In this case the smooth portion 3 of the wall of the sleeve progressively closes the grooved zone from the top downwards as shown in FIG. 5*b,* while applying radial clamping thereto, and subsequently ensuring sealing by peripheral radial clamping in contact with the smooth zone 2.

In this case, sealing at the end of assembly is provided at the bottom portion of the sleeve M.

The free edge r of the side wall of the reservoir R is chamfered, and at the end of assembly it comes into abutment against the top shoulder 5 which is carried in this case on the outside of the sleeve M, as shown in FIG. 6*b.*

Figures 7A, 7B, 7C, 8A, 8B, 8C, 9A, 9B, 9C:
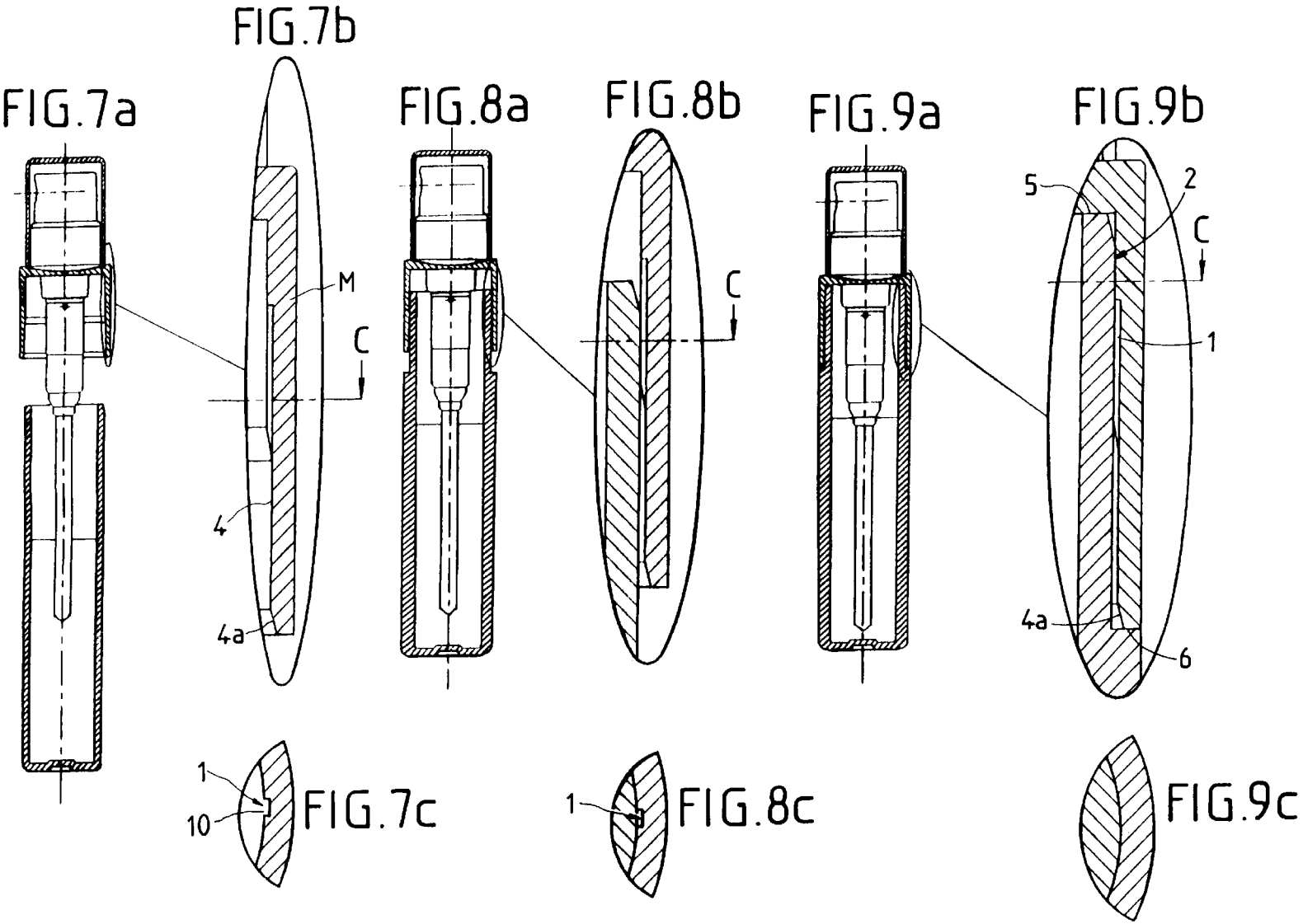

The embodiment shown in FIGS. 7*a,* 8*a,* and 9*a* corresponds to the sleeve M being engaged on the outside of the reservoir R.

The grooved zone 1 and the adjacent smooth zone 2 are carried in this case by the inside face of the side wall of the sleeve M.

This embodiment is symmetrical in configuration to the embodiment shown in FIGS. 1*b,* 2*b,* and 3*b,* and assembly takes place under the same conditions, with the exception of compressed air escaping downwards from the top of the grooved zone 1.

In this case, the top shoulder 5 is carried on the inside of the sleeve M.

In a variant shown in FIGS. 9*a* and 9*b,* the side wall of the reservoir R includes a bottom shoulder 6 forming a stop for the free edge of the side wall of the sleeve M.

The shoulder 6 is preferably of a width that is substantially equal to the thickness of the side wall of the sleeve M in the smooth zone 2 so that the outside of the sleeve lies flush with the reservoir, thereby obtaining continuity of appearance.

The distance between the top and bottom shoulders 5 and 6 then determines the respective heights of the sleeve M and of the neck of the reservoir R.

Figures 10A, 10B, 10C, 11A, 11B, 11C, 12A, 12B, 12C:
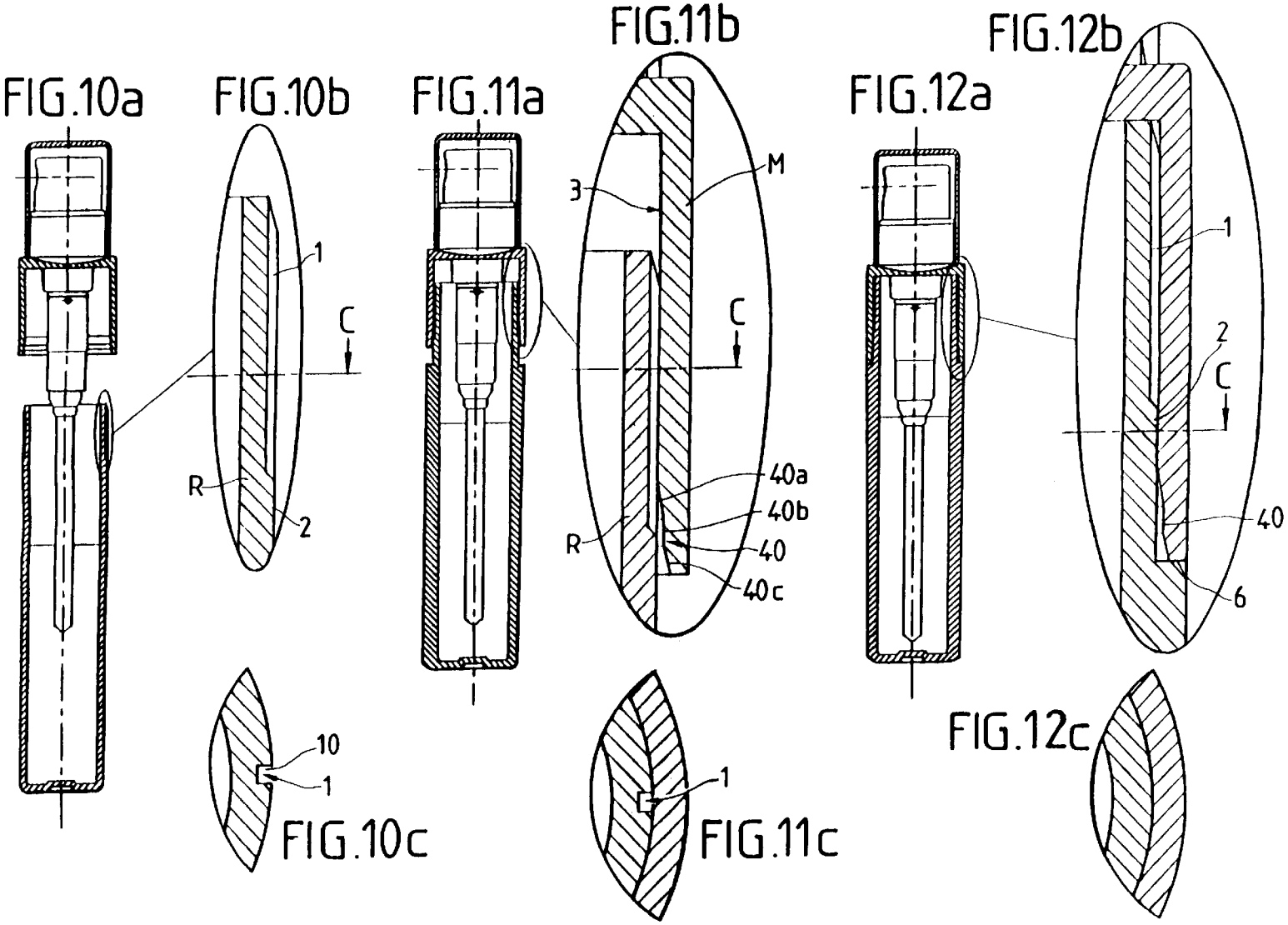

The embodiment shown in FIGS. 10*a,* 11*a,* and 12*a* also corresponds to the sleeve M engaging on the outside of the reservoir R.

However, in this case the grooved zone 1 and the adjacent smooth zone 2 are carried by the outside wall of the neck of the reservoir R.

This embodiment is symmetrical in configuration to that shown in FIGS. 4*b,* 5*b,* and 6*b,* with assembly taking place under the same conditions, but with the exception that compressed air escapes downwards through the grooved zone 1.

As shown in FIGS. 11*b* and 12*b,* the free edge of the sleeve M has a specific aerodynamic shape for optimizing air escape.

This profile comprises a chamfer 40 with two slopes 40*a* and 40*c.*

The two slopes 40*a* and 40*c* may be inclined at different angles and they are spaced apart by a straight portion 40*b* parallel to the side wall of the reservoir R.

Where appropriate, and as shown in the embodiment of FIG. 9*b,* the reservoir may have a flush bottom shoulder 6.

The invention makes it possible to assemble the components in two main modes.

In both modes, the sleeve M is initially positioned on the axis of the neck of the reservoir R, as shown in FIGS. 1*a,* 4*a,* 7*a,* and 10*a.*

Thereafter, it is engaged by force internally or externally by pressing on the cap C and/or on the reservoir R. During an initial sliding stage, this causes the internal air to be compressed, making it escape via the grooved zone 1 of the side wall of the sleeve M or of the reservoir R (as shown in FIGS. 2*a,* 5*a,* 8*a,* and 11*a,* or in detail in FIGS. 2*b,* 5*b,* 8*b,* and 11*b*), after which, during a second stage, complete sealing is provided by peripheral radial clamping between the smooth zones 2 and 3 of the facing bearing surfaces of the sleeve M and of the reservoir R.

In the first mode, forced engagement is performed at constant speed and in continuous manner so as to maintain, at least during venting, continuous equilibrium between the pressure of air inside and outside the reservoir R with gas flowing out via the grooved zone 1.

In the second embodiment, forced engagement is performed discontinuously, in two steps.

During the first step, excess pressure is generated inside the reservoir R by applying force. The small dimensions of the air vent duct defined by the grooved zone 1 and terminated by the smooth portion 3 of the facing wall allow air to escape at a rate that is insufficient for compensating the excess pressure at once.

The resulting intermediate engagement position is maintained for a pause period to allow the compressed air to escape until equilibrium is established between air pressure inside and outside the reservoir R.

Thereafter, during a second step, engagement is continued so as to obtain, in succession, closure of the grooved zone and final sealing by peripheral radial clamping between the facing bearing surfaces.

I claim:

1. An assembly system for providing sealed assembly between a miniature pump whose body is supported by a sleeve, and a reservoir of small capacity, by forced internal or external engagement, wherein a side wall of the sleeve or of the reservoir includes a grooved zone forming a vent which is longitudinally terminated by an adjacent smooth zone; said zones being designed to slide with radial clamping over the entire length to a smooth portion of a facing wall of the reservoir or of the sleeve for the purpose of progressively closing said grooved zone and coming into sealing contact with the smooth zone at the completion of the engagement, said smooth portion having a length which is greater than that of said zones.

2. An assembly system according to claim 1, wherein the grooved zone is of a diameter that is identical to or smaller by no more than 5% than the diameter of the adjacent smooth zone.

3. An assembly system according to claim 1, wherein said sleeve includes a top shoulder constituting a stop for the free edge of the reservoir.

4. An assembly system according to claim 1, wherein said grooved zone and smooth zone are made on the inside wall of the reservoir, for internal engagement of the sleeve.

5. An assembly system according to claim 1, wherein said grooved zone and said smooth zone are formed on the outside wall of the reservoir for external engagement of the sleeve.

6. An assembly system according to claim 1, wherein said grooved zone and smooth zone are made on the inside wall of the sleeve for external engagement thereof.

7. An assembly system according to claim 1, wherein said grooved zone and said smooth zone are formed in the outside wall of the sleeve for internal engagement thereof.

8. An assembly system according to claim 1, wherein said grooved zone is situated in a wall of the sleeve beneath said smooth zone and extends downwards in the form of a bottom zone of smaller diameter.

9. An assembly system according to claim 1, wherein the side wall of the reservoir has a bottom shoulder forming a stop for the free edge of the side wall of the sleeve.

10. An assembly system according to claim 1, wherein the grooved zone is terminated remote from the smooth zone by a chamfered edge.

11. An assembly system according to claim 1, characterized in that the free edge of the side wall of the sleeve and/or of the reservoir is chamfered.

12. An assembly system according to claim 1, wherein said grooved zone includes a single longitudinal groove.

* * * * *